US009743818B2

(12) United States Patent
Peng et al.

(10) Patent No.: US 9,743,818 B2
(45) Date of Patent: Aug. 29, 2017

(54) ADAPTER ASSEMBLY AND SUCTION NOZZLE

(71) Applicant: SUZHOU VACS ELECTRICAL CO., LTD., Jiangsu (CN)

(72) Inventors: Jinsong Peng, Jiangsu (CN); Yu Liang, Jiangsu (CN)

(73) Assignee: SUZHOU VACS ELECTRICAL CO., LTD., Jiangsu (CN)

( * ) Notice: Subject to any disclaimer, the term of this patent is extended or adjusted under 35 U.S.C. 154(b) by 0 days.

(21) Appl. No.: 15/110,471

(22) PCT Filed: Jan. 23, 2014

(86) PCT No.: PCT/CN2014/071265
§ 371 (c)(1),
(2) Date: Jul. 8, 2016

(87) PCT Pub. No.: WO2015/109498
PCT Pub. Date: Jul. 30, 2015

(65) Prior Publication Data
US 2016/0331199 A1 Nov. 17, 2016

(51) Int. Cl.
*A47L 9/24* (2006.01)
*A47L 9/02* (2006.01)

(52) U.S. Cl.
CPC ..... *A47L 9/244* (2013.01); *A47L 9/02* (2013.01); *A47L 9/242* (2013.01)

(58) Field of Classification Search
CPC ..... A47L 9/02; A47L 9/242; A47L 9/244
See application file for complete search history.

(56) References Cited

U.S. PATENT DOCUMENTS 2,727,762 A 12/1955 Ziegler, Jr.
4,079,965 A * 3/1978 Moughty ..... A47L 9/244 174/47
5,740,583 A * 4/1998 Shimada ..... A47L 9/244 15/377
6,148,474 A * 11/2000 Ohara ..... A47L 9/246 15/377

(Continued)

FOREIGN PATENT DOCUMENTS

CN 1402620 A 3/2003
CN 101406376 A 4/2009

(Continued)

*Primary Examiner* — Dung Van Nguyen
(74) *Attorney, Agent, or Firm* — Im IP Law; C. Andrew Im

(57) ABSTRACT

An adaptor assembly and a suction nozzle which includes the adaptor assembly. The adaptor assembly works with the outlet port part of a suction nozzle to adapt the suction nozzle with the extension pipe of a vacuum cleaner in a sealed manner. The adapter assembly includes a tube body with a fitting end to fit the outlet port part and a flange end with a flange for inserting into the extension pipe. A moving and positioning unit is located between the fitting and flange ends, and includes a base part fixed on the tube body and a mobile part cooperating with the base part. An elastic seal ring sleeves around the flange end and includes one end butting against the flange and another end butting against the mobile part. The elastic seal ring arch outwardly and come into tight contact with internal surface of the extension pipe.

9 Claims, 7 Drawing Sheets

(56) References Cited

U.S. PATENT DOCUMENTS

| | | | | |
|---|---|---|---|---|
| 7,516,988 | B2 * | 4/2009 | Lin | A47L 9/244 15/414 |
| 8,038,173 | B2 * | 10/2011 | Canale | A47L 9/244 285/303 |
| 8,567,825 | B2 * | 10/2013 | Canale | A47L 9/244 285/302 |

FOREIGN PATENT DOCUMENTS

| | | | |
|---|---|---|---|
| CN | 201277397 | Y | 7/2009 |
| CN | 102100508 | A | 6/2011 |
| WO | 0008997 | A1 | 2/2000 |
| WO | 2013/077793 | A1 | 5/2013 |

* cited by examiner

A-A section view

A-A section of Fig. 5 with elastic seal ring compressed

ADAPTER ASSEMBLY AND SUCTION NOZZLE

RELATED APPLICATIONS

This application is a §371 application from PCT/CN2014/071265 filed Jan. 23, 2014, which is incorporated herein by reference in its entirety.

FIELD OF THE INVENTION

The present invention relates to an adapter assembly and a suction nozzle includes this adapter assembly.

BACKGROUND OF THE INVENTION

A motor inside vacuum cleaner drives fan blades to rotate in high speed and draws air to move in pre-set direction to create pressure difference in an airflow channel and forms suction force, this suction force is guided to surface to be cleaned to pick up dust with help of different suction nozzles.

The suction nozzle is installed at the forefront of an extension pipe to be in direct contact with dust. Different kinds of suction nozzles are needed for best performance on different kinds of surfaces such as carpet, hard floor, sofa, crevice, etc., vacuum cleaners of different brands often supplied with different suction nozzles, and new suction nozzles are coming into market continuously, all of these make it necessary for some consumers to buy separate suction nozzle and thus have to consider fitting between the new suction nozzle and his vacuum cleaner.

The suction nozzle can connect with the extension pipe by outer fitting method and inner fitting method. In outer fitting method, the extension pipe is inserted into the outlet port part of suction nozzle, so it is important to make the outer part of the lower end of the extension pipe to be in the same shape and size as the internal part of the outlet port part. In inner fitting method, the suction nozzle is inserted into the extension pipe, it is important to make the outer part of the outlet port part to be in the same shape and size as the internal part of the extension pipe.

The most popular vacuum cleaner uses extension pipe with a circular internal air channel and ϕ32 mm outer diameter, for fitting suction nozzle with a circular air channel in the outlet port part and internal diameter is ϕ32 mm. This kind of suction nozzle is the most popular and thus the cheapest, it has all types for different vacuum cleaning task. Vacuum cleaner owners intends to buy a popular ϕ32 mm suction nozzle when necessary. If his extension pipe is not ϕ32 mm externally, or in different shape, he will need an adapter assembly.

The second popular vacuum cleaner uses the extension pipe with a circular internal air channel and a outer diameter of ϕ35 mm.

Internal shape of the extension pipe can be circular, oval, or even square, and circular is the most popular.

For circular extension pipe, the most popular outer diameter is ϕ32 mm, the $2^{nd}$ popular is ϕ35 mm, and the $3^{rd}$ popular is ϕ38 mm.

Some extension pipes have a locker to fit the suction nozzle, although most extension pipes do not have it.

Furthermore, in the competitive vacuum cleaner market, new brands are growing up continuously. Some new brands use suction nozzle with special shape or special size for certain function, or just for being unique. Some of these new brands are very successful in marketing, since they can only supply limited types of suction nozzle, consumer may need more suction nozzles for certain cleaning purpose after buying this kind of unique vacuum cleaners.

So it has been a concern of distributors to make their suction nozzles fit utmost vacuum types. The prevailing method is to supply several cylindrical short tubes together with suction nozzle, hoping at least one of these short tubes can meet consumer's requirement. Since only limited types of short tube can be supplied, and vacuum cleaner with new shape and new size is coming to market continuously, consumer can have difficulty in deciding which adapter or which suction nozzle can fit his vacuum cleaner. For example if his extension pipe is circular, he will have to decide what diameter of suction nozzle he needs, and choose from inner fitting method and outer fitting method. And, since only one of those adapting tubes will work in the final, consumer has to dispose other adapting tubes sent to him, this will be a waste to his money.

Patent file WO2013077793A1 Reservo tries to integrate different adapters to a single unit. The inventor of WO2013077793A1 realized the lower end of the extension pipe of the vacuum cleaner can be circular shape or non-circular, so he designed a detachable tube with non-circular outline in his invention and in the same shape as non-circular extension pipe of a certain vacuum cleaner. This detachable tube is nested in the non-circular internal channel of the adapter. If a consumer's vacuum cleaner happens to be with this specific non-circular size, he can simply take off the detachable tube of WO2013077793A1 Reservo and fit his extension pipe into the adapter. Since the detachable tube in WO2013077793A1 Reservo has circular internal channel with different diameter in different steps, for fitting the extension pipe with different outer diameter respectively, so the adapter disclosed by WO2013077793A1 Reservo can fit more than one vacuum cleaners. However, it can only fit limited pre-set vacuum types, if a vacuum cleaner is out of the pre-set size scope, this adapter will not work. And WO2013077793A1 Reservo can only fit extension pipe with smooth circular outline, if an extension pipe has locker projected out of its lower end, WO2013077793A1 Reservo will not work. So this is not a really universal adapter.

SUMMARY OF THE INVENTION

In order to solve the above mentioned problems, the present invention provides an adapter assembly and a vacuum cleaner which includes the adapter assembly.

The present invention has the following structures.

<Structure 1>

The present invention discloses an adapter assembly for working with the outlet port part of a suction nozzle to adapt the suction nozzle with the extension pipe of a vacuum cleaner in a sealed manner, comprising: a tube body comprises a fitting end to be fitted with the outlet port part and a flange end with a flange for inserting into the extension pipe; a moving and positioning unit located between the fitting end and the flange end, comprises a base part fixed on the tube body and a mobile part cooperating with the base part to perform moving and positioning; and an elastic seal ring sleeved around the flange end, comprises one end butting against the flange and another end butting against the mobile part; wherein the mobile part can make the elastic seal ring arch outwardly and come into tight contact with internal surface of the extension pipe by means of moving and the positioning.

The tube body in present invention can be hollow cylinder, the base part can cooperate with the mobile part through screw-thread, the base portion can be a length of outer screw-thread set on the tube body, the mobile part can comprise a ring blocker butting against the another end of the elastic seal ring and a sleeve tube butting against the ring blocker and sleeve around the outer screw thread with a length of inner screw thread which match with the outer screw thread.

Further, the adapter assembly of the present invention can also have the following feature: the base part and the mobile part cooperate with each other through teeth and slots, the base part includes a plurality of slots arranged along the axial direction of the tube body, the mobile part includes teeth which can match with the slots, when the teeth matched with the slots, the mobile part fixed in certain place to perform the positioning, and when the teeth are moved out of the slots, the mobile part performs the moving alongside axis of the tube body.

Besides, the adapter assembly of the present invention can also have the following features: the fitting end includes a fitting joint to be fitted with the suction nozzle and an supporter for supporting the fitting joint.

Besides, the adapter assembly of the present invention can also have the following features: the fitting joint is integrated with the supporter, and the flange end includes a flange and a fixing body for detachably fixing the flange.

Besides, the adapter assembly of the present invention can also have the following features: the internal surface of the extension pipe is circular in cross section perpendicular to its axis, the elastic seal ring is circular in cross section perpendicular to its axis, when the mobile part performs the moving and the positioning, the elastic seal ring arches outwardly and its outer diameter can reach from 28 mm to 42 mm.

Besides, the adapter assembly of the present invention can also have the following features: when the mobile part performs the moving and the positioning, the outer diameter of the outwardly arching elastic seal ring is in the range of 32 mm~38 mm.

Besides, the adapter assembly of the present invention can also have the following features: the external diameters of different sections of the middle part of the elastic seal ring in the axial direction are equal, and they are all larger than the external diameters of the two side parts of the elastic seal ring.

<Structure 2>

Further, the present invention provides a suction nozzle adapts with the extension pipe of a vacuum cleaner, comprising: a nozzle body comprises an outlet port part; and an adapter assembly for adapting the outlet port part with the extension pipe in a sealed manner, wherein the adapter assembly is anyone as described in the Structure 1.

Effect of the Present Invention

According to the adapter assembly and the suction nozzle provided by the present invention, the flange end with elastic seal ring can insert into extension pipe, and the mobile and positioning portion can move and position to make said elastic seal ring arch outwardly and come into tight contact with the internal surface of the extension pipe. Therefore, the adapter assembly can connect outlet port part of suction nozzle with different kinds of extension pipes having circular airflow channel, no matter what is the internal diameter and outer shape of the extension pipe. Consequently, the adapter assembly can be widely used for connecting the outlet port part with the extension pipe, and accordingly it has a very wide using range and is possible to provide users with great convenience.

BRIEF DESCRIPTION OF THE DRAWINGS

Embodiment of the present invention will now be described with reference to the accompanying drawings in which.

DETAILED DESCRIPTION OF THE INVENTION

Embodiment of the adapter assembly and the suction nozzle will be described in detail herein below with reference to the drawings.

Figure 1:
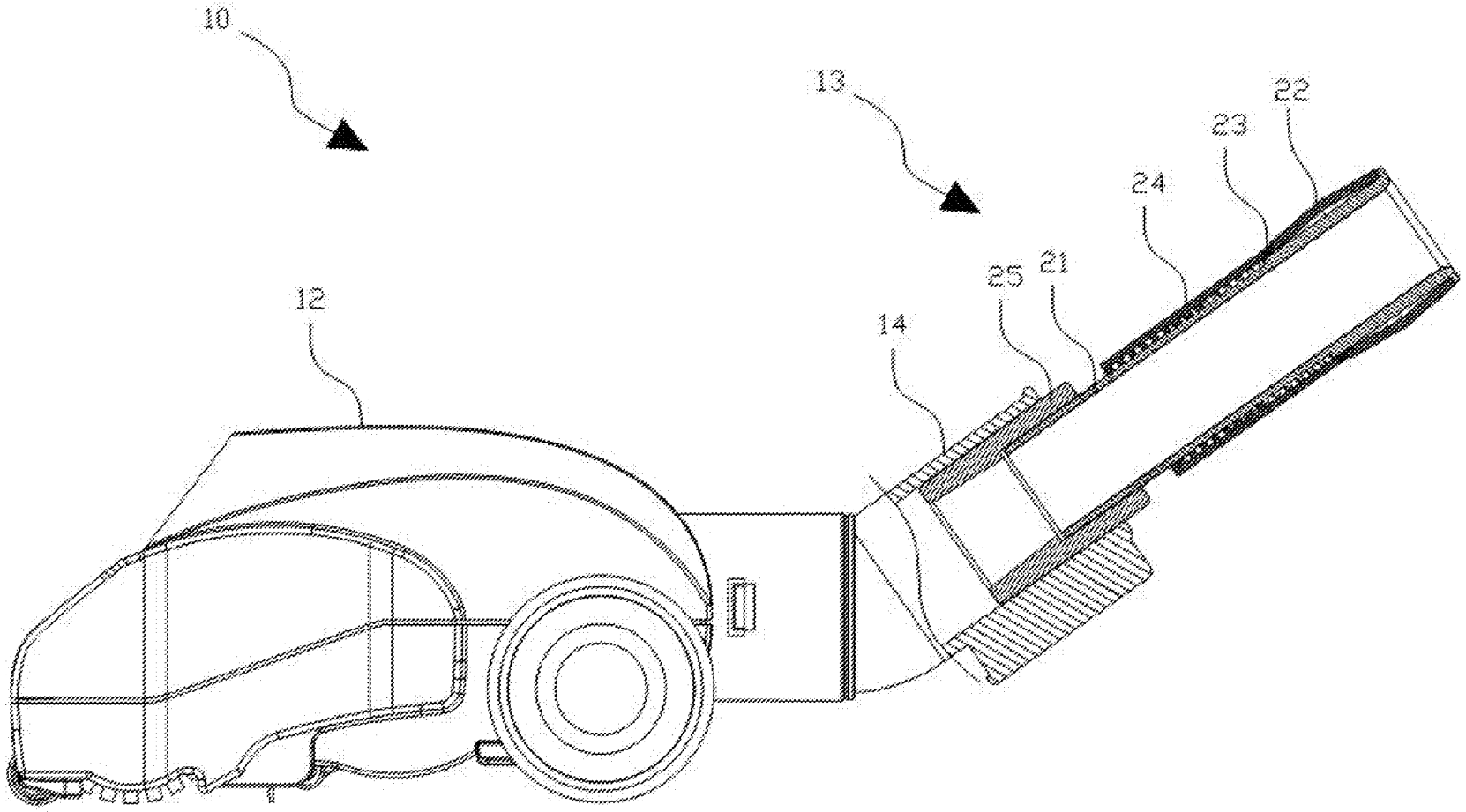
FIG. 1 shows a suction nozzle related to the present invention.
Figure 2:
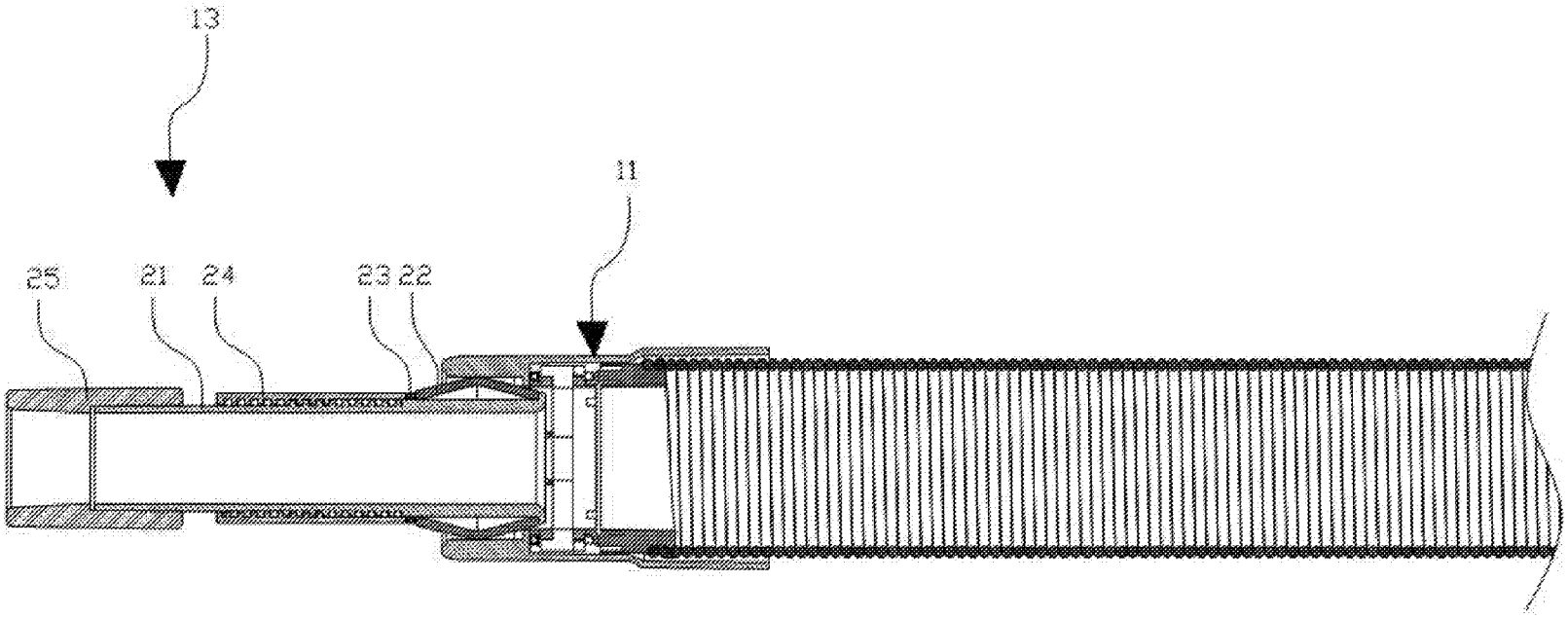
FIG. 2 shows an adapter assembly related to the present invention, and fitted with extension pipe of a vacuum cleaner.
Figure 3:
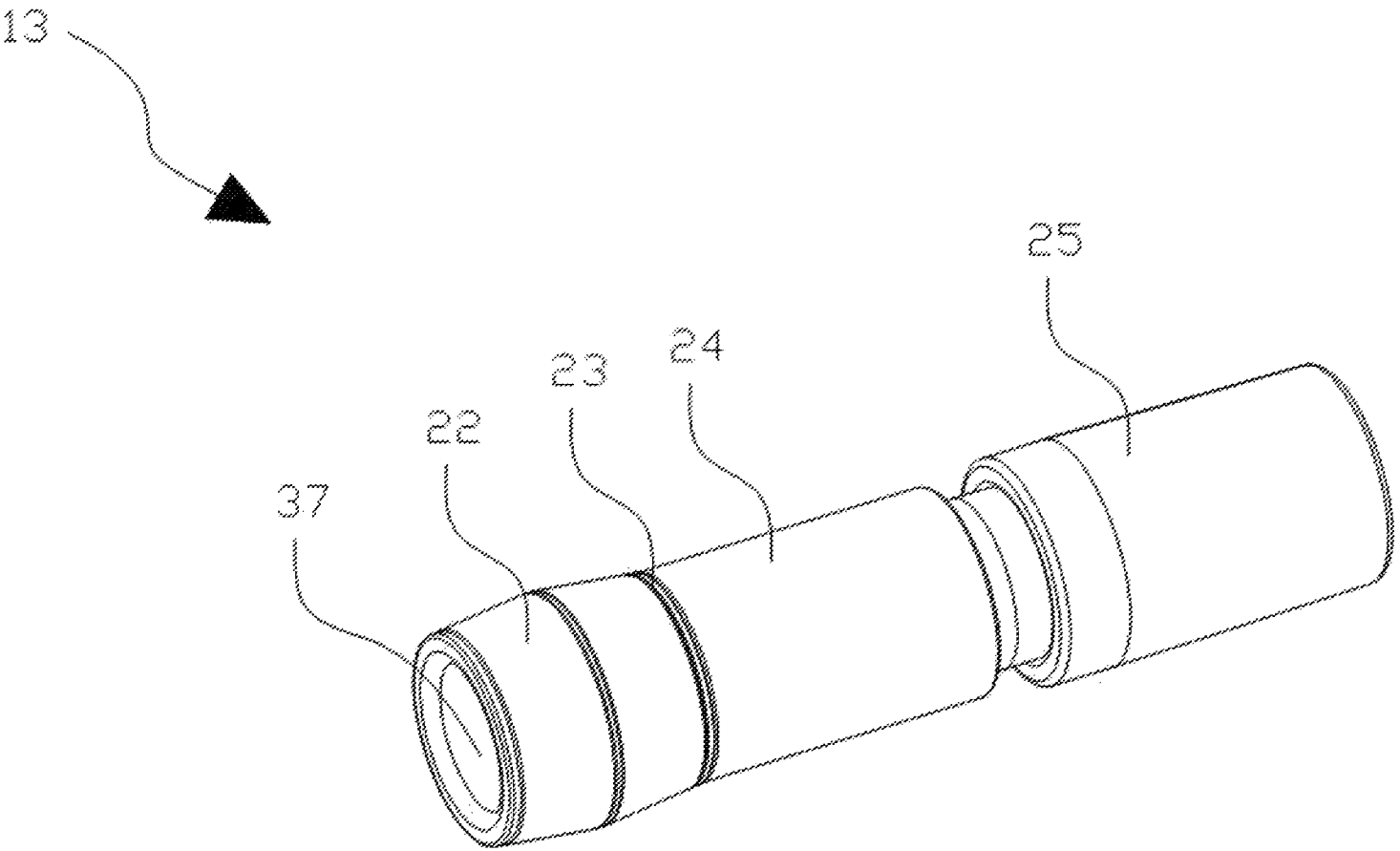
FIG. 3 is a front perspective view of the adapter assembly.

As shown in FIG. 1 and FIG. 2, the suction nozzle 10 is connected with the extension pipe 11 of a vacuum cleaner for removing hair and dust on a surface such as carpet and sofa. The suction nozzle 10 includes a nozzle body 12 and an adapter assembly 13. The nozzle body 12 has an outlet port part 14. One end of adapter assembly 13 is inserted into the outlet port part 14 and the other end is inserted into the extension pipe 11, so as to connect the outlet port part 14 with the extension pipe 11 in a sealed manner.

In the present embodiment, the cross-sectional internal surface of the extension pipe 11 is circular in the direction perpendicular to the axis of the extension pipe 11.

As shown by FIG. 3 to FIG. 7, the adapter assembly 13 comprises a tube body 21, an elastic seal ring 22, a ring blocker 23 and a mobile part 15.

Figure 4:
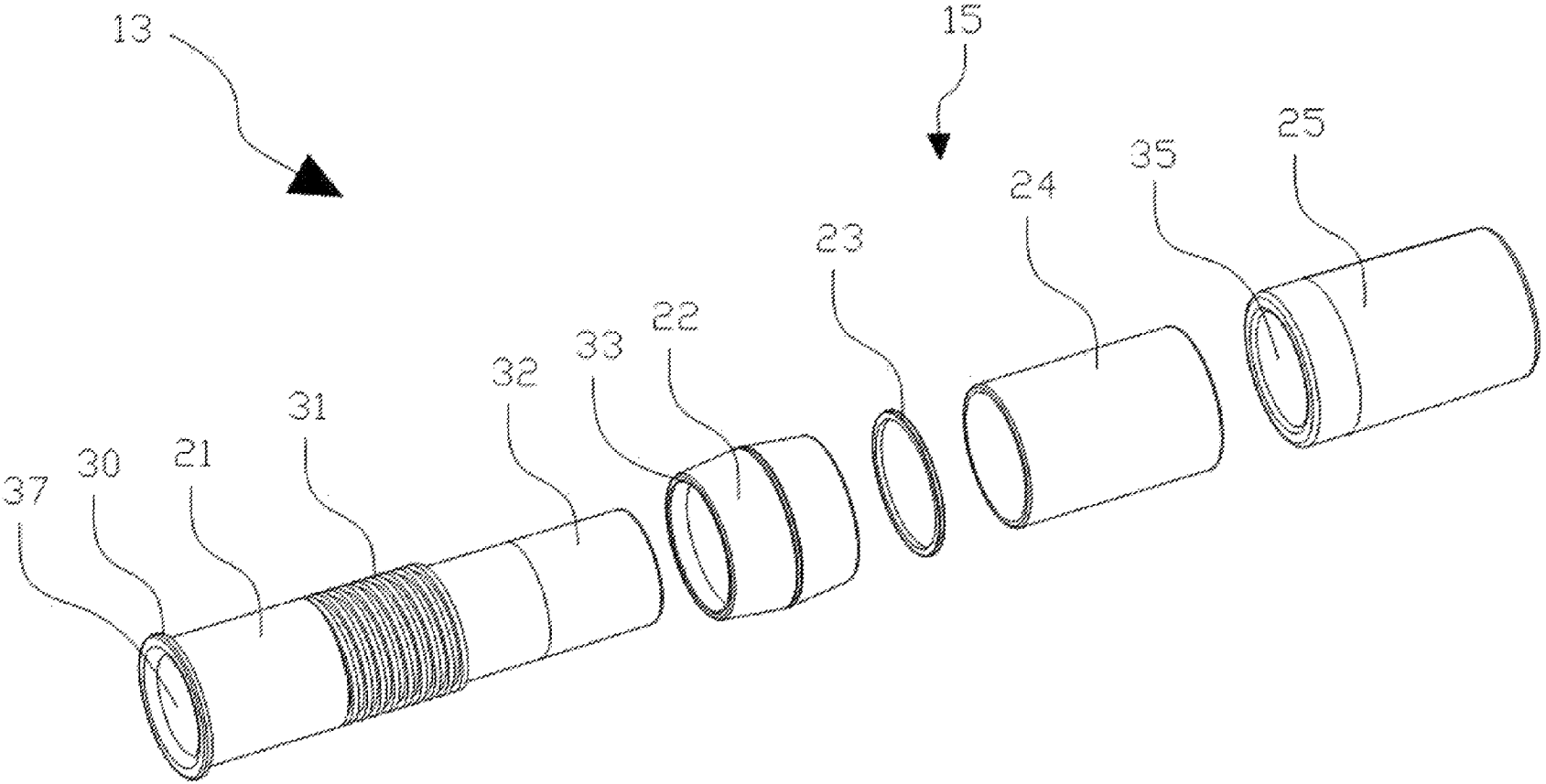
FIG. 4 is an exploded view of the adapter assembly.
Figure 5:
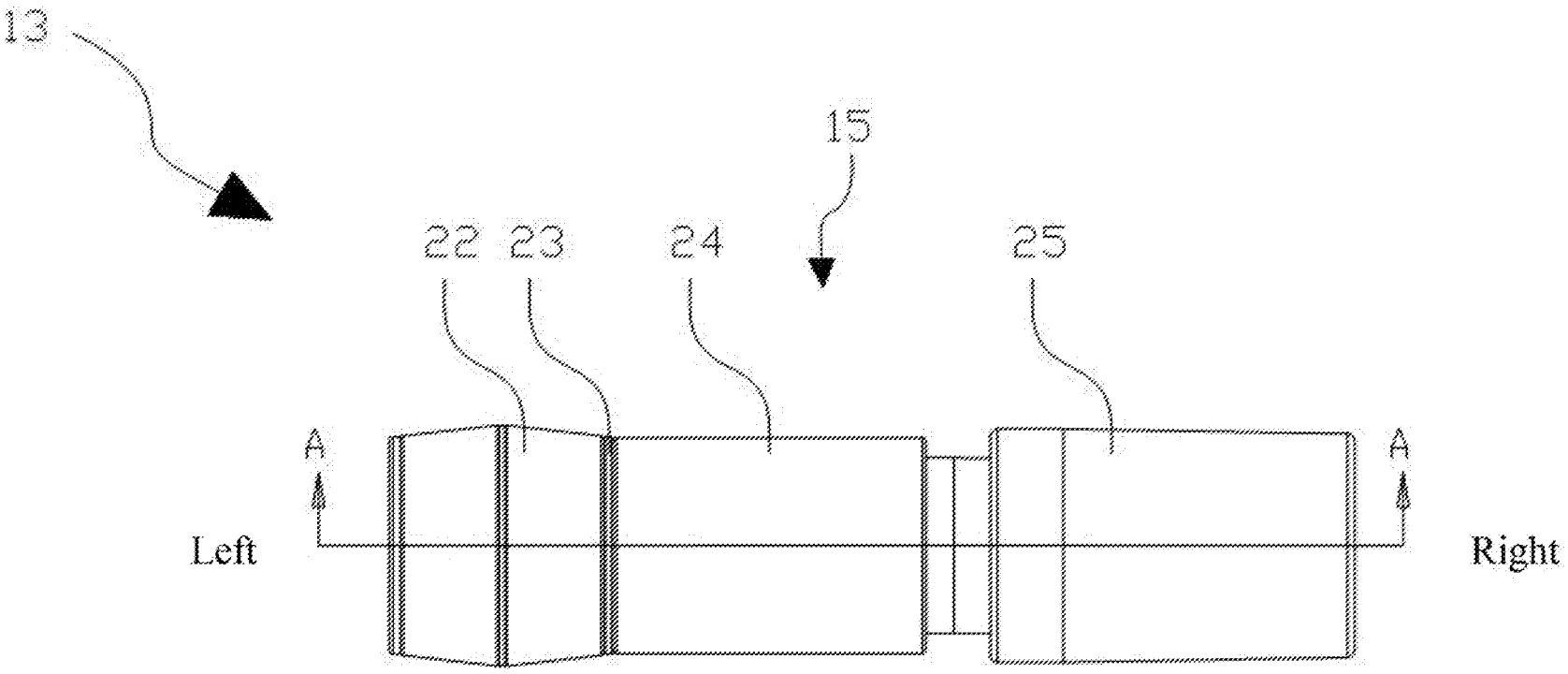
FIG. 5 is a top view of the adapter assembly.
Figure 6:
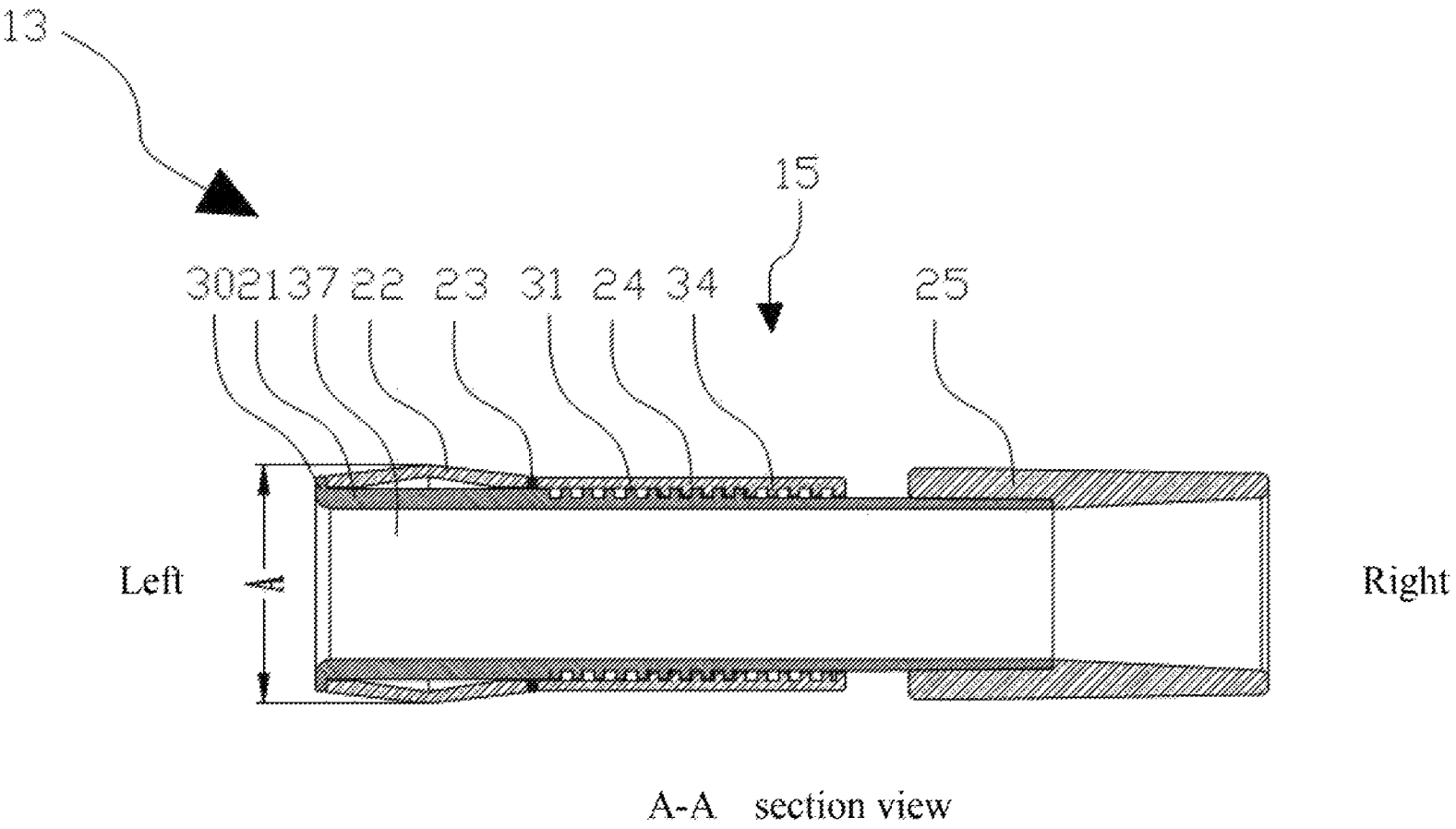
FIG. 6 is A-A section view of FIG. 5 with the elastic seal ring in free state.
Figure 7:
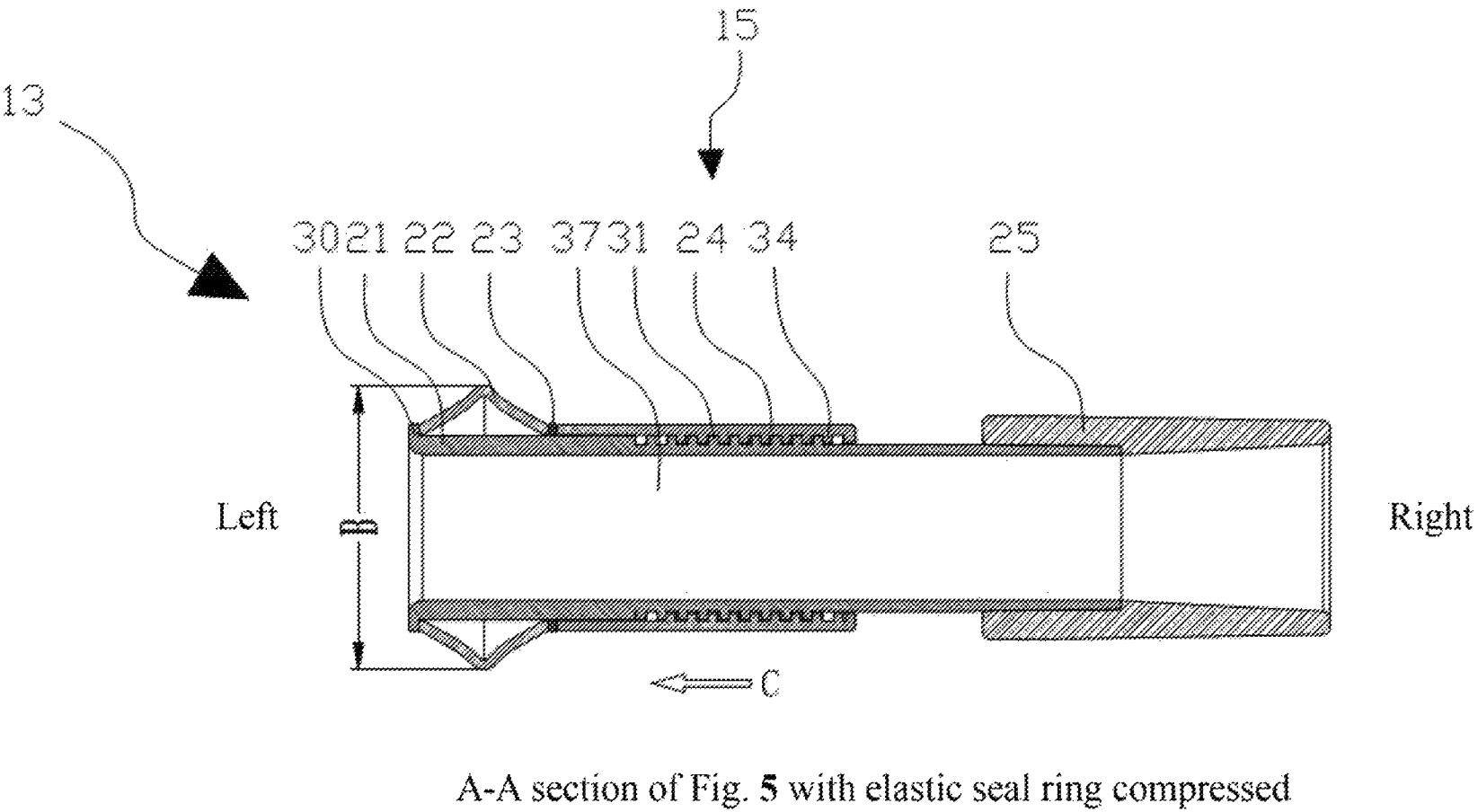
FIG. 7 is A-A section view of FIG. 5 with the elastic seal ring compressed.

As shown by FIG. 4, the circular airflow channel 37 of the tube body 21 is circular in shape, and it is used for transmitting airflow. The outer surface of the tube body 21 is also circular in cross section, and a fitting flange 30, a length of outer screw threads 31, a supporter 32 and a fitting joint 25 are set on the tube body 21 in sequence. The flange 30 blocks one end 33 of the elastic seal ring 22 and ensures the elastic seal ring 22 will not move over the flange 30. The outer screw-thread 31 matches with inner screw-thread 34 (as shown by FIG. 7) on the mobile part 15 and enables the mobile part 15 to move left and right along outer surface of the tube body 21, as shown in FIG. 5~7. When the mobile part 15 moves to left side as shown by arrow C of FIG. 7, it will be closer to the flange 30, and moves to right side means away from the flange 30.

The supporter 32 supports fitting joint 25 through internal air channel 35, and the outer diameter of the fitting joint 25 is ϕ32 mm, for fitting ϕ32 mm internal diameter of outlet port part, which is the most popular connector size in vacuum cleaner industry, as shown by FIG. 4.

In the present embodiment, as shown by FIG. 6, the flange 30 in the left end of the tube body 21 and a part of the tube body 21 supports the elastic seal ring 22 form a flange end, which can be inserted into the extension pipe 11 in use. The fitting joint 25 and the supporter 32 form a fitting end.

The elastic seal ring 22 surrounds the flange end with one end 33 butts against the flange 30 and another end butts against the mobile part 15. The elastic seal ring 22 is made of flexible material with abrasion resistance. When elastic seal ring 22 is in free state, its cross-sectional view in axial direction of tube body is in oval shape, with middle part slightly higher than left and right side. The cross sectional view of elastic seal ring 22 in a direction perpendicular to the axis of tube body 21 is always circular. As shown by FIG. 6, mobile part 15 moves to right end along axis of the tube body 21 and releases elastic seal ring 22 to a free state, the maximum outer diameter A of the elastic seal ring 22 is larger than the outer diameter of the flange 30, and also larger than the outer diameter of the mobile part 15, the size is approximately ϕ32 mm, which is generally equal to the internal diameter of a popular extension pipe of ϕ35 mm, so it can fit tightly with the circular internal air channel of this ϕ35 mm extension pipe, no matter what is its outer shape.

As shown by FIG. 4 and FIG. 7, the mobile part 15 includes a ring blocker 23 and a sleeve tube 24. The left end of the ring blocker 23 butts against the right end 33 of the elastic seal ring 22, and the ring blocker 23 is located between the elastic seal ring 22 and the sleeve tube 24 to prevent the sleeve tube 24 from direct contact with the elastic seal ring 22, so as to ensure the sleeve tube 24 will not twist or scratch the elastic seal ring 22 but can interact with the elastic seal ring 22 along the axis of the mobile part 15 through the ring blocker 23. The sleeve tube 24 surrounds the tube body 21 with inner screw thread 34 matches outer screw thread 31 and with left end of the sleeve tube 24 butts against right end of the ring blocker 23. The mobile part 15 can move left and right along screw thread on the outer surface of the tube body 21 and can stop firmly on different place within screw-thread area, so as to ensure the outer diameter of the elastic seal ring can reach different continuous size within a pre-set range (as shown by FIG. 7).

In the present embodiment, the outer screw thread 31 serves as a base part for cooperating with the mobile part 15 to perform continuous moving and positioning. The base part and the mobile part 15 are both located between said fitting end and said flange end, and jointly constitute a moving and positioning unit.

As shown by FIG. 7, the sleeve tube 24 of the mobile part 15 can move toward left side along axial direction of the tube body 21 in guidance of inner screw thread 34 and outer screw thread 31 to compress the elastic seal ring 22 through the ring blocker 23, so as to make the middle part of the elastic seal ring 22 with the largest external diameter arch outwardly to form a circular skirt surrounding the tube body 21, the maximum external diameter B of the skirt may reach up to 42 mm, and therefore it can come into tight contact with the internal surface of the extension pipe with a circular air channel and a internal diameter up to 42 mm. The extension pipe with ϕ42 mm internal air channel means its outer diameter is larger than ϕ45 mm, which is already too large for an adult to hold in hand with comfort, so it is not popular in use.

When the elastic seal ring 22 is in a state between two states as shown in FIGS. 6 and 7, the maximum external diameter of elastic seal ring 22 can reach different continuous size pre-set within the range from ϕ32 mm to ϕ42 mm, so as to get tight contact with all extension pipes with a circular internal air channel and with diameter size falls in a range from ϕ32 mm to ϕ42 mm.

Therefore, in the present embodiment, one end of the adapter assembly 13 can fit tightly with all the extension pipes with circular internal air channel whose inner diameter falls in size range from ϕ32 mm to ϕ42 mm, and the other end of the adapter assembly 13 can fit the most popular suction nozzle of ϕ32 mm.

As shown by FIG. 1 and FIG. 2, consumer can insert the fitting joint 25 of the adapter assembly 13 into the outlet port part 14 to get a tight fitting, and insert the flange end into the extension pipe 11, then turn the sleeve tube 24 and push the ring blocker 23 to move toward the flange 30 and compress the elastic seal ring 22, so as to make the elastic seal ring 22 arch from the middle part and butt against the internal surface of extension pipe 11 to reach a sealed fitting between the outlet port part 14 and the extension pipe 11.

Effect of Present Embodiment

According to the adapter assembly and the suction nozzle of the present embodiment, the flange end with elastic seal ring can insert into the extension pipe, and the mobile part can move and position to make the elastic seal ring arch outwardly and come into tight contact with the internal surface of the extension pipe. Therefore, the adapter assembly can adapt outlet port part of suction nozzle with extension pipes having circular air channel in different inner diameter, no matter what the outer shape of extension pipe is and no matter whether they have locker on outer surface. This adapter assembly is widely universal and easy for use.

Furthermore, in the adapter assembly of the present embodiment, the outer surface of the tube body is circular in cross section perpendicular to axis of the tube body, the outer surface of the elastic seal ring is also circular in this cross section, and the base part matches the mobile part through screw thread for tight fit in continuous size to compress the elastic seal ring and spread the outer diameter of the elastic seal ring to reach every of continuous size between ϕ32 mm to ϕ42 mm, instead of reaching only several pre-set diameters in this range. With structure in the present embodiment, the adapter assembly can fit all the extension pipes with a circular air channel and an inner diameter between ϕ32 mm to ϕ42 mm, so it has much wider adaptability.

When a consumer needs an adapter assembly or a suction nozzle for his vacuum cleaner, he just check the air channel shape of his vacuum cleaner, if it is circular, he can then choose the adapter assembly or suction nozzle of the present invention, no need spend time to find exact fitting size of his vacuum cleaner since he can always get correct size after getting the adapter assembly or suction nozzle of the present invention. This makes it very easy for consumer to make decision, and saves him from buying more adapters and dispose incorrect ones.

The adapter assembly and suction nozzle of present invention include but not limit to the particular structure described in the above embodiment. It should be understood that the embodiment and drawings are to be taken as illustrative only and not in a limiting sense. The present invention includes all equivalent variations as limited by the scope of the claims.

In above embodiment, the adapter assembly can adapt suction nozzle to extension pipe with an air channel internal diameter from ϕ32 mm to ϕ42 mm. The adapter assembly in this invention is not limited to work with this size range, but can work with all sizes of air channel internal diameter. This can be done by simply changing the maximum diameter of elastic seal ring after arched outwardly, for example in order to fit the extension pipe with an internal diameter from ϕ28 mm to ϕ45 mm, just make the maximum diameter of the elastic seal ring to fall in size range of ϕ28 mm to ϕ45 mm. Furthermore, since the most popular internal diameter of the extension pipe falls in size range of ϕ32 mm to ϕ38 mm, the present invention preferably provides an adapter assembly for fitting this size collection.

Besides, the internal diameter of the extension pipe of the vacuum cleaner for metal processing factory and sawmill can be as large as ϕ50 mm. If it is necessary to adapt the regular suction nozzle to this kind of industrial vacuum cleaner, just enlarge both internal and external diameter of the adapter assembly in the present invention, or to make the elastic seal ring longer so as to ensure the maximum diameter of the elastic seal ring can reach ϕ50 mm after being arched.

Besides, in the above embodiment, the cross sectional shape of the outer surface alongside axial direction is oval, with the middle part slightly higher than both ends, and the outline of the middle part is in a curved shape as the two side parts. When the elastic seal ring of the present invention is in free state, the middle part of its cross sectional shape alongside the axial direction can also be straight line so as to form a trapezoid in axial cross-section. In this case, when the elastic seal ring arched outwardly to form skirt edge, the top of skirt edge can be wider for better fitting with the internal surface of the extension pipe.

Besides, adapter assembly in above embodiment is for adapting extension pipe with circular internal air channel. If internal air channel is not strict circular, for example deformed slightly with machining tolerance or by alien impact, elastic seal ring in above embodiment can also become this deformed shape and get tight fitting.

Besides, in the above embodiment, the adapter assembly and the outlet port part of the suction nozzle are detachably connected. In the present invention, the fitting end of the adapter assembly and the outlet port part can also be integrated, and the adapter assembly can adapt to different extension pipes through the elastic seal ring sleeved on the flange end.

Besides, in the above embodiment, the flange 30 is integrated with the tube body 21. In order for easy assembly of the elastic seal ring 22 and the sleeve tube 24, the fitting joint 25 must be independent to the supporter 32. They can be detachably assembled together, and also be ultra-sonic welded together after assembly of other components. The flange in the adapter assembly of the present invention can also be detachably assembled onto the tube body, then the fitting joint and the supporter can be integrated since the elastic seal ring and the sleeve tube can be assembled onto the tube body by detaching flange in advance. The flange 30 can also be ultra-sonic welded onto the tube body after the elastic seal ring and the sleeve tube assembled in place.

Besides, the screw-thread is applied in the above embodiment for moving and positioning and for further adjusting the shape of the elastic seal ring 22. This function can also be realized with other methods, for example a teeth-slot structure. In the teeth-slot structure, there will have a plurality of slots in the base portion arranged on the tube body and alongside axis direction, and the mobile part includes a plurality of teeth for matching said slots. When teeth are lifted out of the slots, the mobile part will be able to move and, when teeth fall into slots, the mobile part will be fixed in pre-set place and compress the elastic seal ring to arch outwardly. Structure of this kind will be relatively complicated, and the mobile part can only be fixed in pre-set places, but it still can be an optional method. If neighboring slots are close enough to each other, it is still possible to make the maximum outer diameter of the elastic seal ring to fit the internal air channel of different popular extension pipes.

Besides, outer diameter of fitting joint 25 in above embodiment is ϕ32 mm, for matching outlet port part 14 with inner diameter ϕ32 mm. Outer diameter of fitting joint 25 can also be other sizes, for example ϕ35 mm for fitting outlet port part with inner diameter ϕ35 mm.

Besides, the fitting joint can also fit the outlet port part from outside, and the outlet port part to be inserted into the fitting joint for tight matching.

Besides, the fitting joint 25 in the above embodiment is a short stiff tube. It can also be in other forms, for example to be a flexible hose for fitting with the target suction nozzle.

Besides, the fitting joint 25 of the present invention can also be with flange end, plus moving and positioning assembly, plus elastic seal ring, and fit the outlet port part in the same method as fitting the extension pipe. This kind of adapter assembly can fit not only the extension pipe with different inner diameters, but also the outlet port part with different diameters, so to have wider adaptability.

The invention claimed is:

1. An adaptor assembly for working with a outlet port part of a suction nozzle to adapt said suction nozzle with a extension pipe of a vacuum cleaner in a sealed manner, comprising:

a tube body comprising a fitting end to be fitted with said outlet port part and a flange end with a flange insertable into said extension pipe;

a moving and positioning unit, located between said fitting end and said flange end, comprising a base part fixed on said tube body and a mobile part cooperating with said base part to perform moving and positioning relative to said tube body;

an elastic seal ring, sleeved around said tube body, comprising a first end butting against said flange and a second end butting against said mobile part; and wherein said mobile part is configured to arch outwardly said elastic seal ring into a tight contact with an internal surface of said extension pipe by performing said moving and positioning.

2. The adaptor assembly according to claim 1, wherein said tube body is a hollow cylinder, said base part cooperates with said mobile part through a screw thread, said base part is a length of an outer screw thread set on said tube body; and wherein said mobile part comprises a ring blocker butting against said second end of said elastic seal ring and a sleeve tube butting against said ring blocker and a sleeve around said outer screw thread with a length of an inner screw thread which corresponds with said outer screw thread.

3. The adaptor assembly according to claim 1, wherein said base part and said mobile part cooperate with each other through teeth and slots, said base part includes a plurality of slots arranged along the axial direction of said tube body, said mobile part includes teeth which corresponds with said slots; wherein said mobile part is fixed in a place to perform said positioning when said teeth are matched in said slots; and wherein said mobile part performs said moving alongside an axis of said tube body when said teeth are out of said slots.

4. The adaptor assembly according to claim 1, wherein said fitting end includes a fitting joint to be fitted with said suction nozzle and a supporter for supporting said fitting joint.

5. The adaptor assembly according to claim 4, wherein said fitting joint is integrated with said supporter, and said flange end includes a flange and a fixing body for detachably fixing said flange.

6. The adaptor assembly according to claim 1, wherein the internal surface of said extension pipe is circular in cross section perpendicular to its axis; wherein said elastic seal ring is circular in cross section perpendicular to its axis; and wherein said elastic seal ring arches outwardly and its outer diameter is in a range of 28 mm-42 mm in response said mobile part performing said moving and said positioning.

7. The adaptor assembly according to claim 6, wherein the outer diameter of the outward arching elastic seal ring is in the range of 32 mm-38 mm in response to said mobile part performing said moving and said positioning.

8. The adaptor assembly according to claim 6, wherein external diameters of different sections of a middle part of said elastic seal ring in an axial direction are equal to each other and larger than external diameters of two side parts of said elastic seal ring.

9. A suction nozzle adapts with the extension pipe of the vacuum cleaner, comprising:

a nozzle body comprises an outlet port part; and the adaptor assembly of claim 1 to adapt said outlet port part with said extension pipe in a sealed manner.

* * * * *